US006098243A

United States Patent [19]

Kim

[11] Patent Number: 6,098,243

[45] Date of Patent: Aug. 8, 2000

[54] DEVICE FOR DRIVING/STOPPING BRUSH OF VACUUM CLEANER

[75] Inventor: Sung Guen Kim, Kyongsangnam, Rep. of Korea

[73] Assignee: LG Electronics, Inc., Seoul, Rep. of Korea

[21] Appl. No.: 09/291,948

[22] Filed: Apr. 15, 1999

[30] Foreign Application Priority Data

Apr. 15, 1998 [KR] Rep. of Korea ..... 98-5938
Dec. 5, 1998 [KR] Rep. of Korea ..... 98-53221

[51] Int. Cl.[7] ..... A47L 9/00

[52] U.S. Cl. ..... 15/390; 15/332

[58] Field of Search ..... 15/389, 390, 332, 15/333

[56] References Cited

U.S. PATENT DOCUMENTS

| | | | |
|---|---|---|---|
| 2,094,138 | 9/1937 | White | 15/390 X |
| 2,250,282 | 7/1941 | Swann | 15/390 X |
| 2,601,698 | 7/1952 | Humphrey | 15/390 |
| 2,627,623 | 2/1953 | Humphrey | 15/390 X |
| 2,797,430 | 7/1957 | Thornwald | 15/332 |
| 5,537,712 | 7/1996 | Weber et al. | 15/332 X |
| 5,768,746 | 6/1998 | Kamatani et al. | 15/390 |
| 5,839,160 | 11/1998 | Wang et al. | 15/390 |

*Primary Examiner*—Chris K. Moore

[57] ABSTRACT

Device for driving/stopping a brush of a vacuum cleaner, including a driving motor built in a body of the vacuum cleaner, a brush fitted in front of the driving motor in the body of the vacuum cleaner, a support frame fixed inside of the body and having the motor shaft of the driving motor rotatably passed through a surface thereof, a first link of a circular arc cam form rotatably mounted on an outer circumference of the motor shaft passed through the support frame centered on the motor shaft without interference with the motor shaft and having a belt shaft fitted at a fore end thereof, a belt for connecting between the belt shaft and the brush, a change over lever fitted at one side of rear of the motor shaft in the support frame to be rotatable centered on a hinge shaft and having a foot step for applying a stepping force thereto for connecting/disconnecting a driving force of the motor to the brush, a second link of an arch form connected between a middle of an arm of the change over lever and the belt shaft, and an elastic member connected between a rear wall of the support frame and one side of the arm of the change over lever, whereby allowing to transmit a driving force of a motor shaft to a brush without shift of the belt to the motor shaft direction and provide a convenience by eliminating the necessity of the users bending down for the belt shift handling lever.

10 Claims, 12 Drawing Sheets

DEVICE FOR DRIVING/STOPPING BRUSH OF VACUUM CLEANER

BACKGROUND OF THE INVENTION

1. Field of the Invention

The present invention relates to a vacuum cleaner, and more particularly, to an improved device for driving/stopping a brush of a vacuum cleaner, which transmits a motor driving force to a brush, selectively.

2. Background of the Invention

In general, the vacuum cleaner, for collecting foreign matters, such as dusts, stuck on a surface of a cleaning object by means of suction power of a motor, is widely used in families and industries. In the meantime, recent vacuum cleaners may be provided with a function in which a brush is put into action in cases textile, such as carpet, is cleaned and the brush is not put into action in cases floor and the like are cleaned.

FIG. 1 illustrates a plan view of a related art device for driving/stopping a brush of a vacuum cleaner, with a nozzle cover 27 removed therefrom. The related art device for driving/stopping a brush of a vacuum cleaner will be explained with reference to FIG. 1.

Referring to FIG. 1, the related art device for driving/stopping a brush of a vacuum cleaner is provided with a driving motor 2 built in a body 1 for generating a driving force, a belt 8 connecting a motor shaft 4 of the driving motor 2 and a brush 3 to be moving along the motor shaft 4 for facilitating selective transmission of a rotation force to the brush 3, the brush 3 mounted to be rotatable when the brush 3 is directly connected to the belt 8 to receive a driving force, an idling ring 25 adapted to be coupled to one side of an outer circumference of the brush 3 to permit idling, a belt shift handling lever 26 adapted to push a side of the belt 8 to move the belt 8 in left/right direction selectively so that the belt 8 connects the idling ring 25 and the motor shaft 4 or the belt 8 connects the brush 3 and the motor shaft 4. The belt shift handling lever 26 is projected out of a nozzle cover 27 for users easy handling.

The operation of the related art device for driving/stopping a brush of a vacuum cleaner will be explained.

When the user intends to clean textile, such as carpet, the belt 8 is set to a position at which the belt 8 connects the motor shaft 4 and the brush 3 directly. That is, upon pushing the belt shift handing lever 26 in an arrow direction in FIG. 1 such that the belt 8 connects the motor shaft 4 and the brush 3 directly, a driving force of the motor 2 is directly transmitted to the brush 3, to rotate the brush 3, thereby carrying out brushing of textile, such as carpet. Meanwhile, in the case when a hard floor surface is cleaned, the belt shift handling lever 26 is pushed to an opposite direction from a state in FIG. 1, to shift the belt 8 to an opposite direction of the arrow, so that the belt 8 connects the motor shaft 4 and the idling ring 25. Consequently, the motor driving force is connected up to the idling ring 25, but not to the brush 3, making the vacuum cleaner to carry out cleaning without the brushing.

However, in the related art device for driving/stopping a brush of a vacuum cleaner, in a case when the belt shift handling lever 26 is pushed in an intention to shift the belt 8 to the idling ring 25, a side of the belt 8 which is connected to the motor shaft 4 and rotates at a fast speed is pushed by the belt shift handling lever 26. According to this, there is a great friction caused between the belt 8, adapted to hold a position and keep on rotating, and the belt shift handling lever 26, pushing the side of the belt 8, with a wear down of the belt 8, thereby shortening a lifetime of the belt 8. Moreover, in the related art device for driving/stopping a brush of a vacuum cleaner, it is not convenient for the user to bend himself down to reach to the belt shift handling lever 26 projected out of the nozzle cover 27 during use of the cleaner.

SUMMARY OF THE INVENTION

Accordingly, the present invention is directed to the device for driving/stopping a brush of a vacuum cleaner that substantially obviates one or more of the problems due to limitations and disadvantages of the related art.

An object of the present invention is to provide a device for driving/stopping a brush of a vacuum cleaner, which can transmit a driving force of a motor shaft to a brush without shift of the belt to the motor shaft direction and provide a convenience by eliminating the necessity of the users bending down for the belt shift handling lever.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the device for driving/stopping a brush of a vacuum cleaner, including a driving motor built in a body of the vacuum cleaner, a brush fitted in front of the driving motor in the body of the vacuum cleaner, a support frame fixed inside of the body and having the motor shaft of the driving motor rotatably passed through a surface thereof, a first link of a circular arc cam form rotatably mounted on an outer circumference of the motor shaft passed through the support frame centered on the motor shaft without interference with the motor shaft and having a belt shaft fitted at a fore end thereof, a belt for connecting between the belt shaft and the brush, a change over lever fitted at one side of rear of the motor shaft in the support frame to be rotatable centered on a hinge shaft and having a foot step for applying a stepping force thereto for connecting/disconnecting a driving force of the motor to the brush, a second link of an arch form connected between a middle of an arm of the change over lever and the belt shaft, and an elastic member connected between a rear wall of the support frame and one side of the arm of the change over lever.

In another aspect of the present invention, there is provided a device for driving/stopping a brush of a vacuum cleaner including a driving motor built in a body of the vacuum cleaner, a brush fitted in front of the driving motor in the body of the vacuum cleaner, a support frame fixed in the body and having a motor shaft pass through hole with the motor shaft of the driving motor rotatably passed therethrough and a guide long hole of an arch form, a belt shaft passed through the guide long hole for being moved along the guide long hole, a belt for connecting the belt shaft and the brush, a change over lever fitted to the support frame on a surface thereof at rear of the motor shaft to be rotatable centered on a hinge shaft and having a foot step at a fore end thereof for applying a stepping force thereto, for connecting/disconnecting a driving force of the motor to the brush, connection links each connected between a middle of an arm of the change over lever and the belt shaft and having an elastic piece notch at one side thereof; and an elastic piece having a fixation end fixed to one side of a top portion of the support frame and a free end formed downwardly, for the free end pressing down upper sides of the connection links when the change over lever is upright and preventing return of the change over lever by the free end being caught at the notches in the connection links as the change over lever is rotated in a direction in which the driving force transmitted to the brush is cut off.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIGS. 3*a* to 3*c* illustrate operation of the device for driving/stopping a brush of a vacuum cleaner shown in FIG. 2, wherein, FIG. 3*a* illustrates a front view showing a driving force of the motor is cut off so as not to transmit to a brush, FIG. 3*b* illustrates a front view showing the driving force of the motor is being transmitted to a brush, and FIG. 3*c* illustrates a front view showing a driving force of the motor is being cut off so as not to transmit to a brush;

FIGS. 6*a* and 6*b* illustrate operation of the device for driving/stopping a brush of a vacuum cleaner shown in FIG. 4, wherein, FIG. 6*a* illustrates a front view showing a driving force of the motor is cut off so as not to transmit to a brush, FIG. 6*b* illustrates a back view of FIG. 6*a;*

FIGS. 7*a* and 7*b* illustrate operation of the device for driving/stopping a brush of a vacuum cleaner shown in FIG. 4, wherein, FIG. 7*a* illustrates a front view showing the driving force of the motor is being transmitted to a brush, and FIG. 7*b* illustrates a back view of FIG. 7*a.*

DETAILED DESCRIPTION OF THE PREFERRED EMBODIMENT

Figure 1:
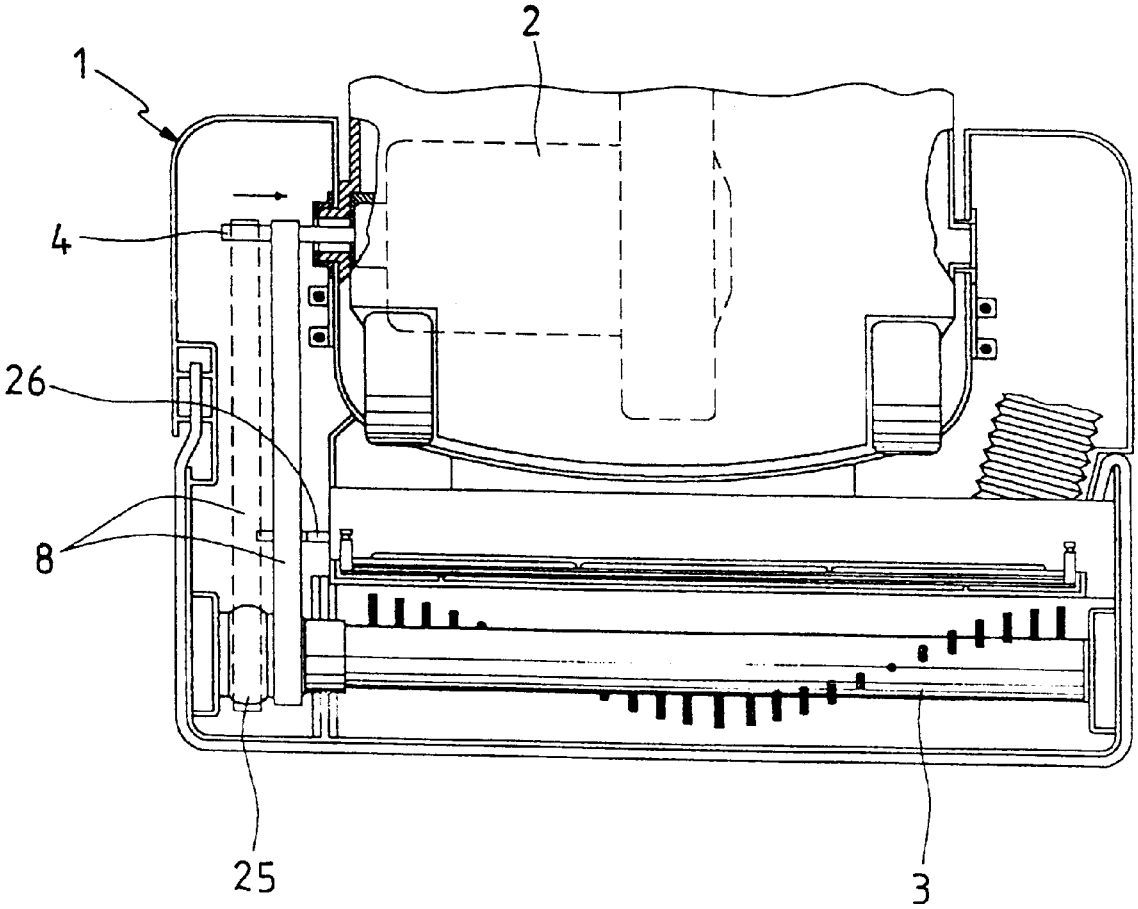
FIG. 1 Background Art
FIG. 1 illustrates a plan view of a related art device for driving/stopping a brush of a vacuum cleaner.
Figure 2:
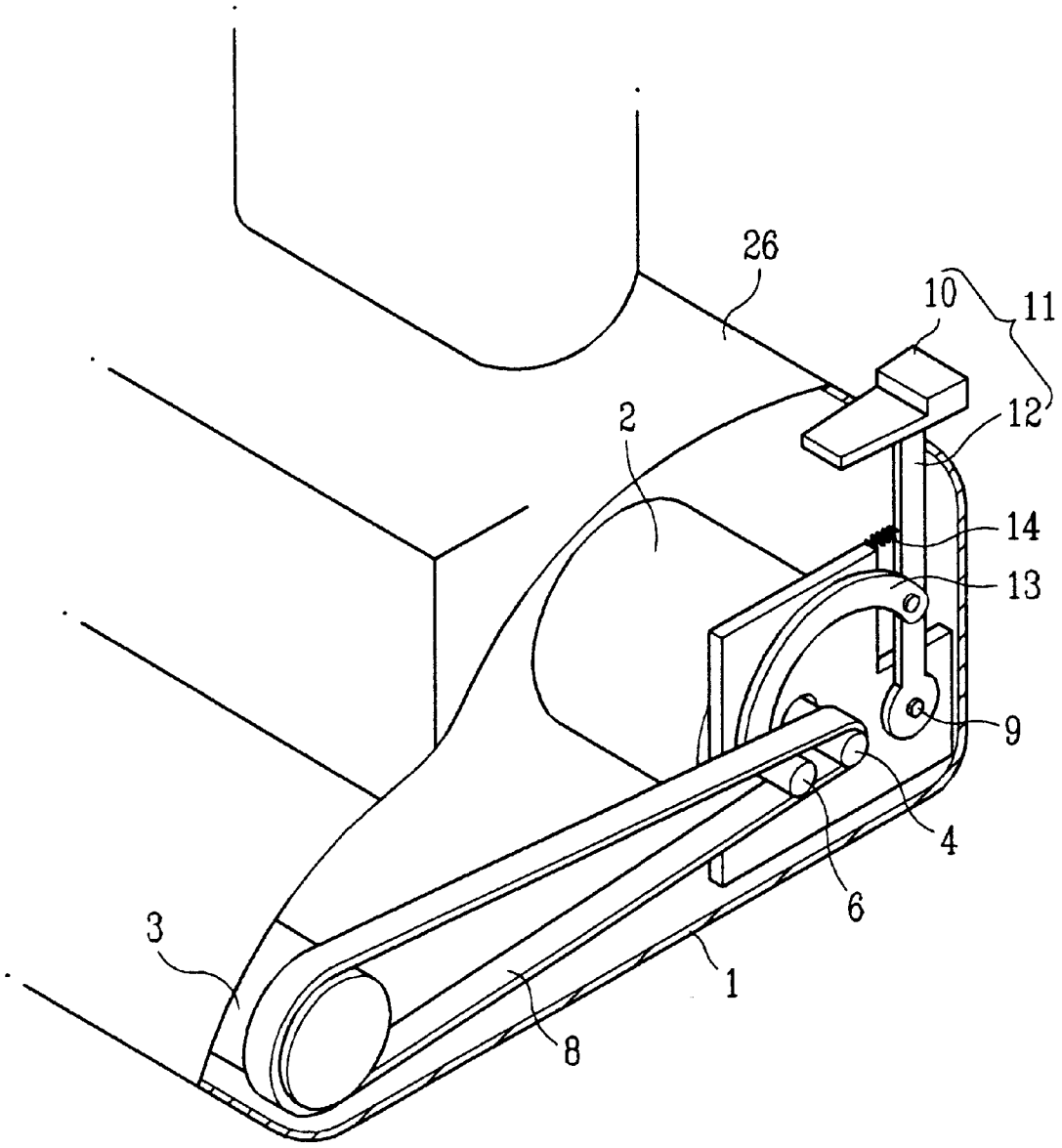
FIG. 2 illustrates a perspective view of a part of a vacuum cleaner showing a device for driving/stopping a brush of a vacuum cleaner in accordance with a first preferred embodiment of the present invention applied thereto.
Figure 3A:
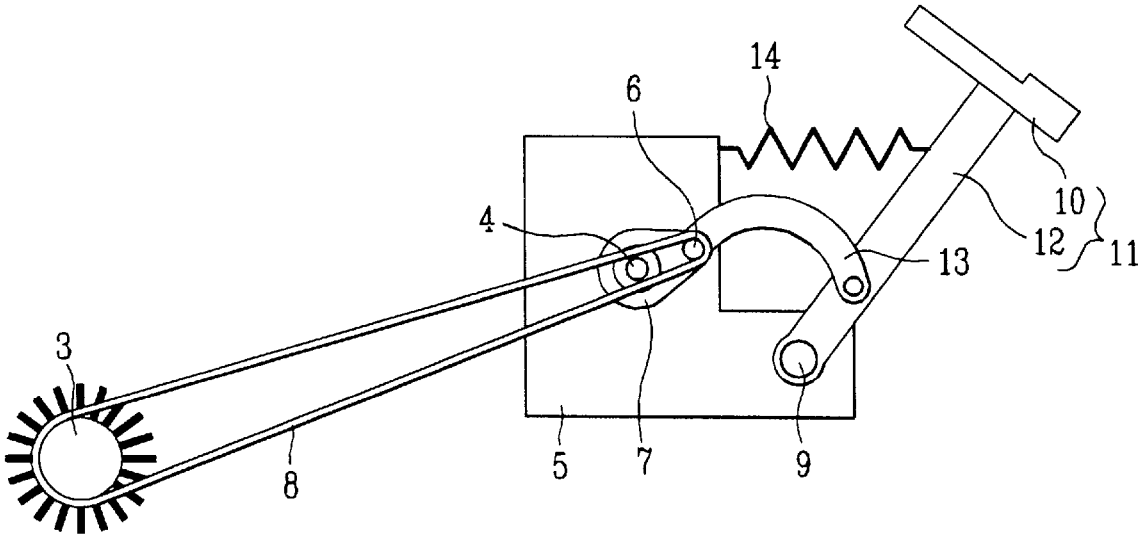
Figure 3B:
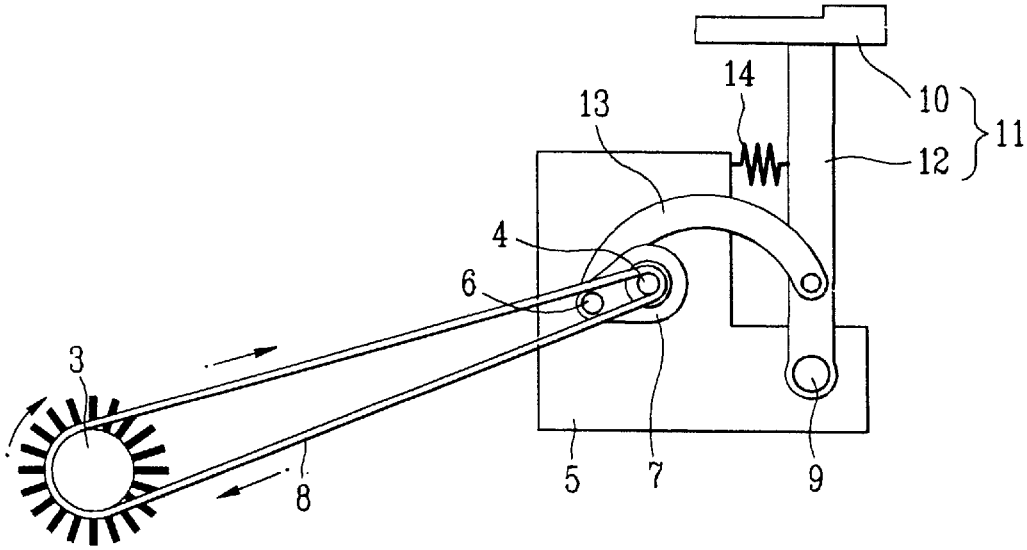

Reference will now be made in detail to the preferred embodiments of the present invention, examples of which are illustrated in the accompanying drawings. FIG. 2 illustrates a perspective view of a part of a vacuum cleaner showing a device for driving/stopping a brush of a vacuum cleaner in accordance with a first preferred embodiment of the present invention applied thereto, and FIGS. 3*a* to 3*c* illustrate operation of the device for driving/stopping a brush of a vacuum cleaner shown in FIG. 2.

Figure 3C:
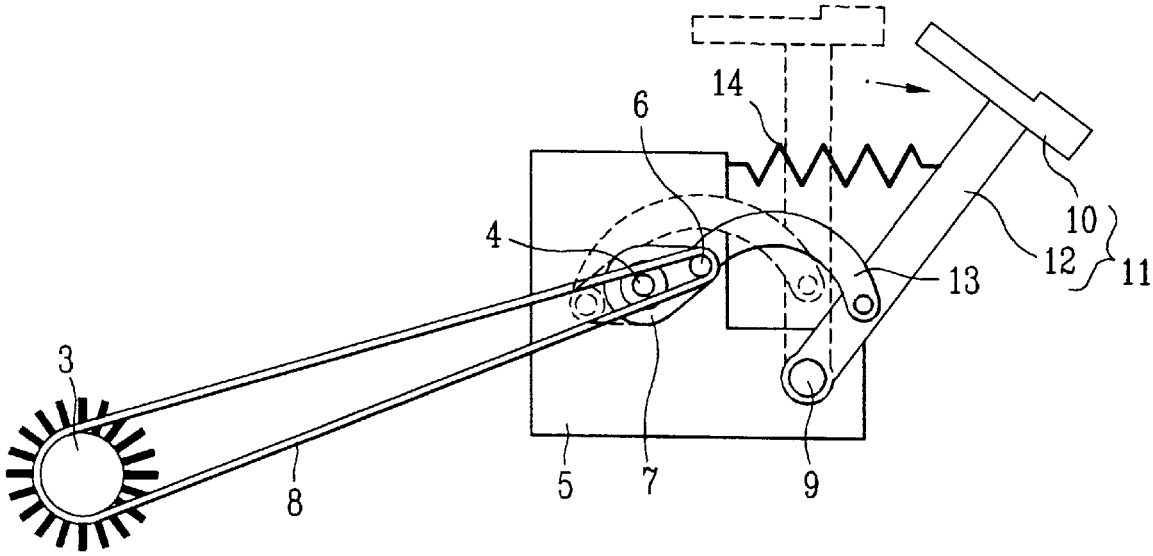

Referring to FIGS. 2~3*c,* the device for driving/stopping a brush of a vacuum cleaner in accordance with a first preferred embodiment of the present invention includes a driving motor 2 built in a body 1 of the vacuum cleaner, a brush 3 fitted in front of the driving motor 2 in the body 1 of the vacuum cleaner, a support frame 5 fixed inside of the body 1 and having the motor shaft 4 of the driving motor 2 rotatably passed through a surface thereof, a first link 7 of a circular arc cam form rotatably mounted on an outer circumference of the motor shaft 4 passed through the support frame 5 centered on the motor shaft 4 without interference with the motor shaft 4 and having a belt shaft 6 fitted at a fore end thereof, a belt 8 for connecting between the belt shaft 6 and the brush 3, a change over lever 11 rotatably fitted centered on a hinge shaft 9 at one side of rear of the motor shaft 4 in the support frame 5(a right side of the motor shaft 4 in the drawing) and having a foot step 10 for applying a stepping force thereto for connecting/disconnecting a driving force of the motor 2 to the brush 3, a second link 13 of an arch form connected between a middle of an arm 12 of the change over lever 11 and the belt shaft 6, and an elastic member 14 connected between a rear wall of the support frame 5 and one side of the arm 12 of the change over lever 11. It is preferable that the belt shaft 6 has a diameter slightly greater than the motor shaft for preventing interference between the motor shaft 4 and the belt 8 when the power is cut off.

The operation of the aforementioned device for driving/stopping a brush of a vacuum cleaner in accordance with a first preferred embodiment of the present invention will be explained.

When a user presses a selection switch(not shown) for turning on the vacuum cleaner for cleaning, dusts and other contaminants on a surface of cleaning object is drawn inside of the body 1 of the vacuum cleaner by a suction of the vacuum cleaner. In this instance, the brush 3 may or may not be rotated depending on a surface condition of the cleaning object. That is, when the cleaning object is textile, such as carpet, the brush 3 is put into use, and when the cleaning object is a hard surface, such as a floor, the brush 3 is not put into use.

The operation of the device for driving/stopping a brush of a vacuum cleaner in accordance with a first preferred embodiment of the present invention in the case the cleaning object is textile, such as carpet will be explained in detail.

Referring to FIG. 3*a,* under a state when a rotating power of the motor shaft 4 is not transmitted to the brush 3 as the belt 8 is connected between the motor shaft 4 and the belt shaft 6, when the user presses the change over lever 11 forward with a foot(a left side in the drawing), the change over lever 11 starts to rotate in a counter clockwise direction, and the change over lever 11 is rotated rapidly by a restoration of the elastic member 14 even if no operational force is applied thereto started from a time point the change over lever 11 is passed through a toggle point. As a pulling force to forward of the drawing(a left side in the drawing) is applied from the restoration force of the elastic member 14 to the second link 13 of an arch form connected to the arm 12 of the change over lever 11, there is a force exerted on the first link 7 of a circular arc cam form connected to the second link 13 of an arch form to rotate the first link 7 centered on the motor shaft 4. According to this, the first link 7 of a circular arc cam is rotated taking the motor shaft 4 as an axis to be in a state as shown in FIG. 3*b*. In this instance, the stepping force of the user which pushes the change over lever 11 forward should be enough to overcome a locking state of the change over lever 11 locked by a toggle action of the first link 7 and the second link 13. When the change over lever 11 overcomes a locked state into an upright state as shown in FIG. 3*b,* the belt 8, having connected between the belt shaft 6 and the brush 3, connects the motor shaft 4 and the brush 3. Consequently, the driving force of the motor 2 is transmitted to a shaft of the brush 3 through the belt 8 on the motor shaft 4, to rotate the brush 3, thereby making brushing on the textile, such as carpet, carrying out an efficient cleaning of the cleaning object surface.

In the meantime, when it is intended to clean a floor surface or a hard surface without the carpet, the user rotates the change over lever 11 in a clockwise direction centered on the hinge shaft 9 by applying a stepping force onto the foot step 10 of the change over lever 11. That is, as shown in FIG. 3*b,* under a state the motor shaft 4 and the brush 3 shaft are connected by the belt 8, upon a stepping force is applied to the change over lever 11 such that the change over lever 11 is rotated in a clockwise direction on the drawing centered on the hinge shaft 9, the change over lever 11 is rotated as shown in the arrow in FIG. 3*c*, pulling the elastic member 14. On the same time with this, as a pulling force toward rear of the drawing(right side of the drawing) is applied to the second link 13 of an arch form connected to the arm 12 of the change over lever 11, a pulling force is also applied to a fore end of the first link 7 of a circular arc cam form connected to the second link 13. Since the first link 7 of a circular arc cam form is rotatably coupled on an outer circumference of the motor shaft 4, the change over lever 11 rotates from a state shown in imaginary lines to a state shown in solid lines. That is, as the stepping force is applied to the change over lever 11 to rotate in the clockwise direction on the drawing, an initial state in which the belt shaft 6 is positioned between the motor shaft 4 and the brush 3 is changed to a state in which the motor shaft 4 is positioned between the belt shaft 6 and the brush 3, cutting off the transmission of the driving force of the motor 2 to the belt 8, to idle the motor shaft 4, thereby cutting off the transmission of the driving force of the motor 2 to the brush 3 at the end. Meanwhile, as a tension of the belt 8 is exerted on the belt shaft 6 from a time point the belt shaft 6 is passed through the toggle point, the change over lever 11 can be held in a locked state regardless of the restoration force of the elastic member 14. In summery, the device for driving/stopping a brush of a vacuum cleaner in accordance with a first preferred embodiment of the present invention can connects/disconnects a motor driving force transmission to the brush 3 by means of an interlocked action of the first link 7 of a circular arc cam form, the second link 13, the belt shaft 6 at a fore end of the first link 7, and the belt 8.

Figure 4:
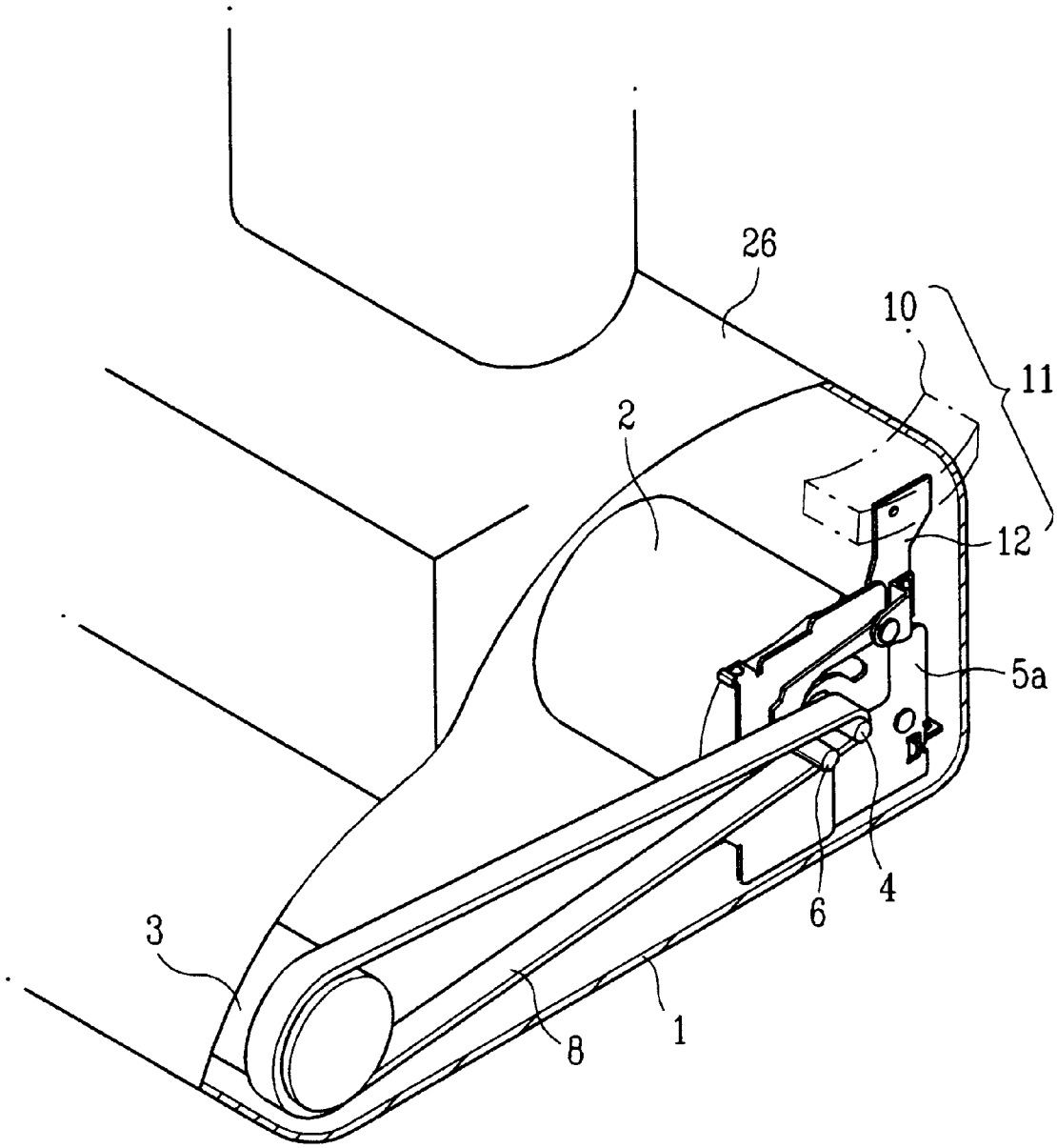
FIG. 4 illustrates a perspective view of a part of a vacuum cleaner showing a device for driving/stopping a brush of a vacuum cleaner in accordance with a second preferred embodiment of the present invention applied thereto.
Figure 5A:
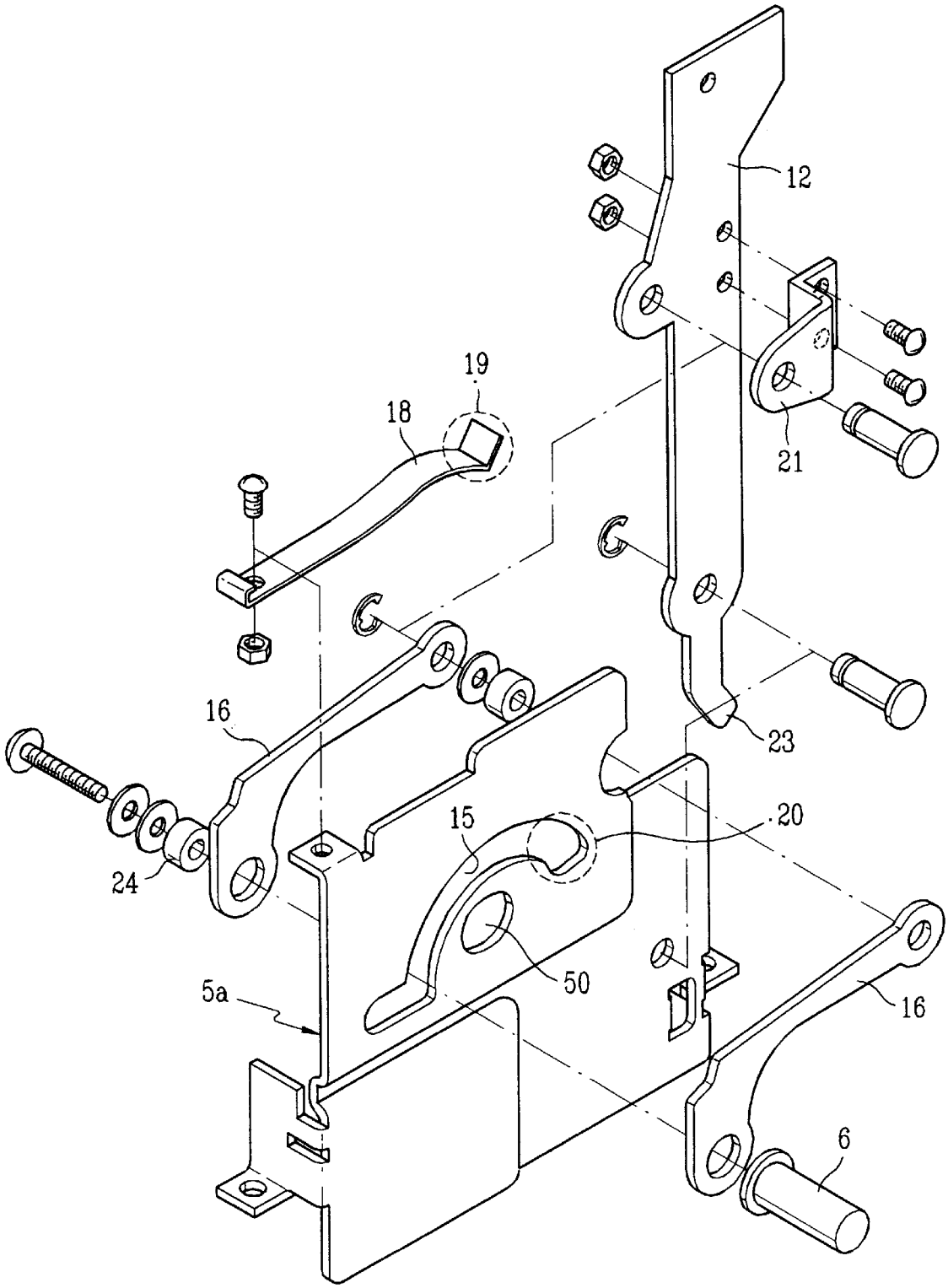
FIG. 5*a* illustrates a perspective disassembled view of the device for driving/stopping a brush of a vacuum cleaner in FIG. 4.
Figure 5B:
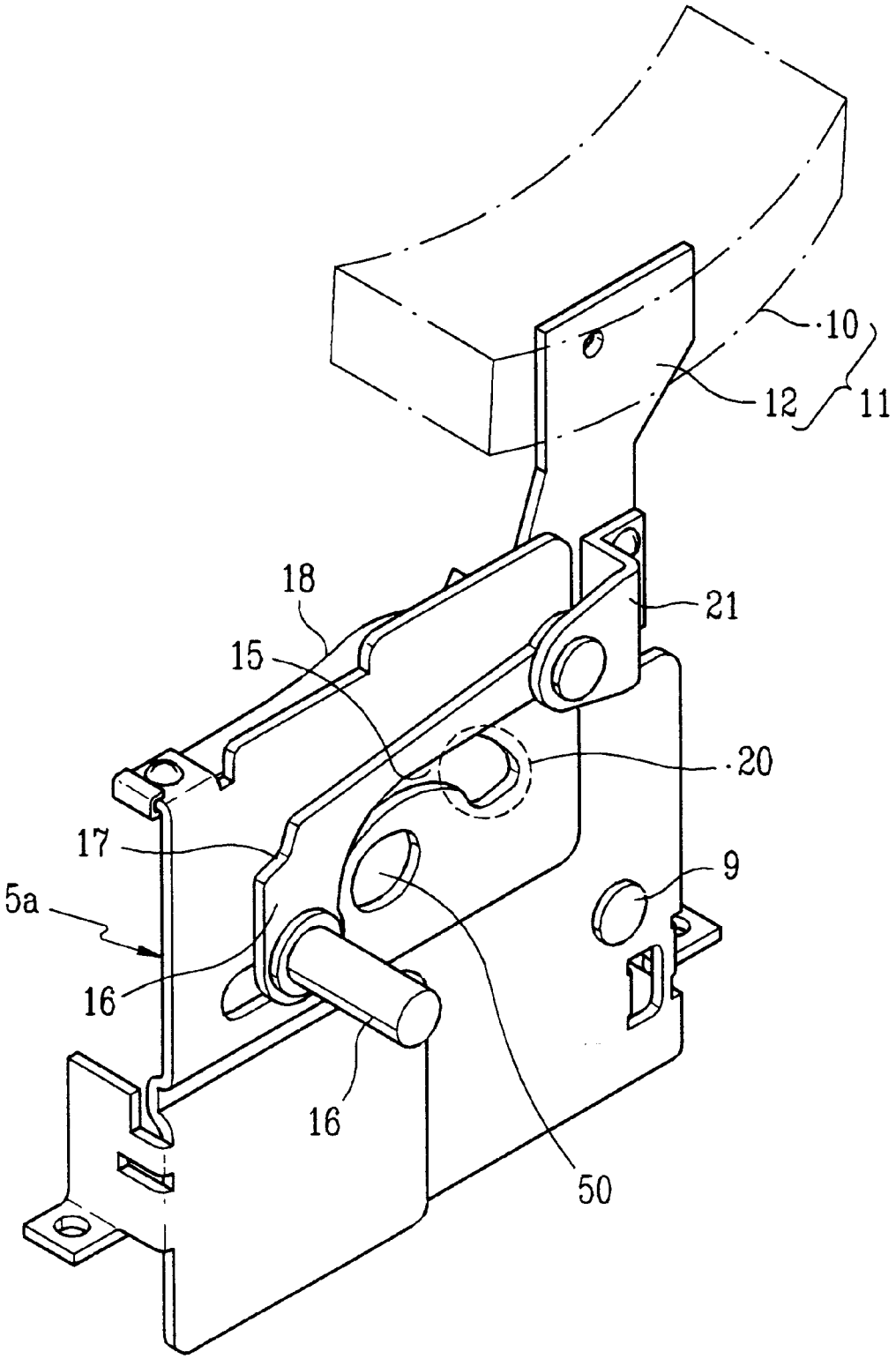
FIG. 5*b* illustrates a perspective view showing an assembled view of the device for driving/stopping a brush of a vacuum cleaner in FIG. 5*a,* and FIG. 5*c* illustrates a back perspective view of the device for driving/stopping a brush of a vacuum cleaner in FIG. 5*b,*.
Figure 5C:
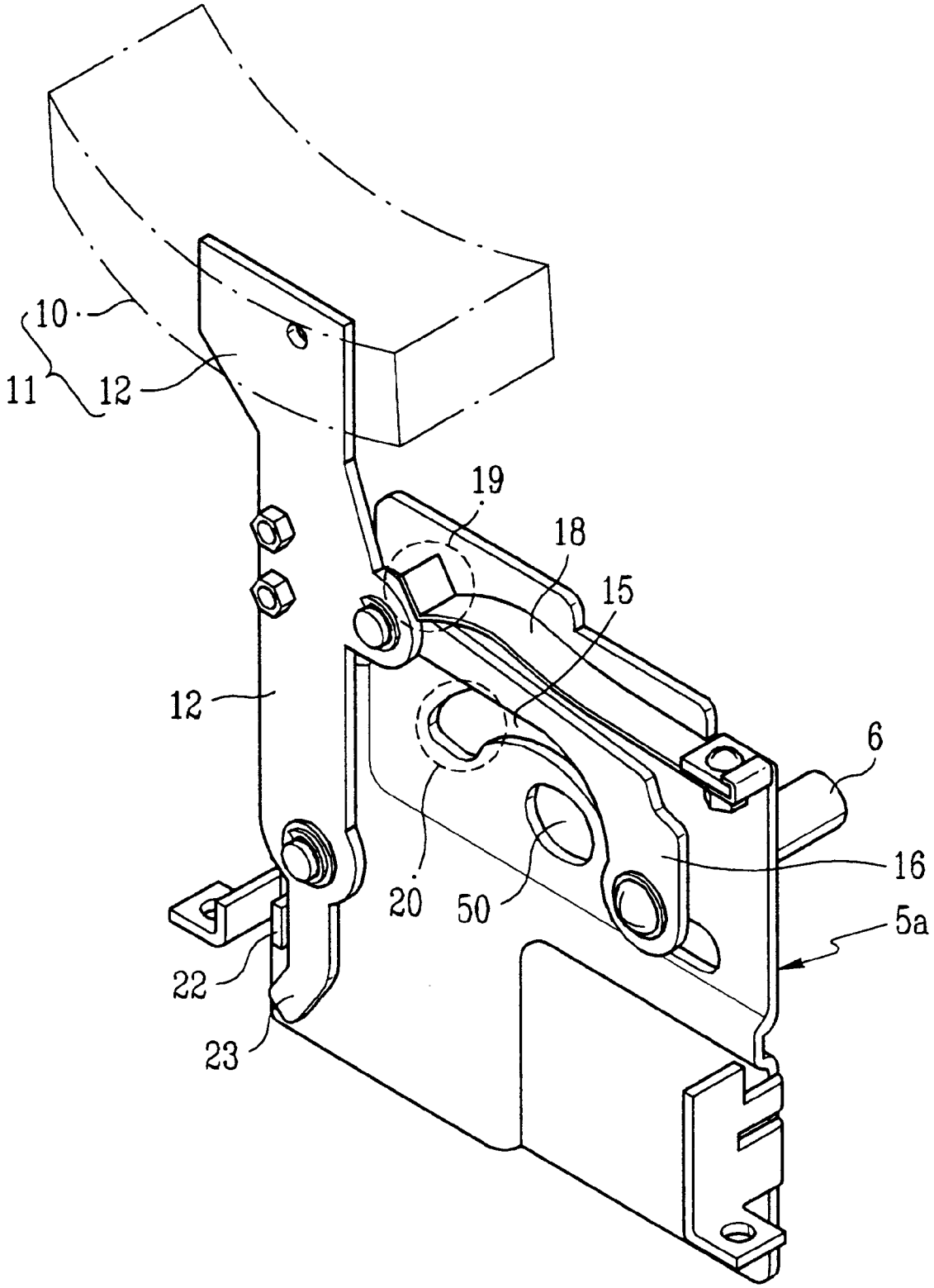

A device for driving/stopping a brush of a vacuum cleaner in accordance with a second preferred embodiment of the present invention will be explained with reference to FIG. 4~FIG. 7*b*. Components of the second embodiment similar to the first embodiment in view of system are given the same reference names and numerals. FIG. 4 illustrates a perspective view of a part of a vacuum cleaner showing a device for driving/stopping a brush of a vacuum cleaner in accordance with a second preferred embodiment of the present invention applied thereto, FIG. 5*a* illustrates a perspective disassembled view of the device for driving/stopping a brush of a vacuum cleaner in FIG. 4, FIG. 5*b* illustrates a perspective view showing an assembled view of the device for driving/stopping a brush of a vacuum cleaner in FIG. 5*a,* and FIG. 5*c* illustrates a back perspective view of the device for driving/stopping a brush of a vacuum cleaner in FIG. 5*b*.

And, FIGS. 6*a*–7*b* illustrate operation states of the device for driving/stopping a brush shown in FIG. 4, wherein the motor driving force connected and disconnected states are shown in front and back views, respectively.

Referring to FIGS. 4~7*b,* the device for driving/stopping a brush of a vacuum cleaner in accordance with a second preferred embodiment of the present invention includes a driving motor 2 built in a body 1 of the vacuum cleaner, a brush 3 fitted in front of the driving motor 2 in the body 1 of the vacuum cleaner, a support frame 5*a* fixed in the body 1 and having a motor shaft pass through hole 50 with the motor shaft 4 of the driving motor 2 rotatably passed therethrough and a guide long hole 15 of an arch form, a belt shaft 6 passed through the guide long hole 15 for being moved along the guide long hole 15, a change over lever 11 fitted to the support frame 5*a* on a surface thereof at rear of the motor shaft 4 to be rotatable centered on a hinge shaft 9 and having a foot step 10 at a fore end thereof for applying a stepping force thereto, for connecting/disconnecting a driving force of the motor to the brush 3, connection links 16 each connected between a middle of an arm 12 of the change over lever 11 and the belt shaft 6 and having an elastic piece notch 17 at one side thereof, and an elastic piece 18 having a fixation end fixed to one side of a top portion of the support frame 5*a* and a free end formed downwardly, for the free end pressing down upper sides of the connection links 16 when the change over lever 11 is upright and preventing return of the change over lever 11 by the free end being caught at the notches 17 in the connection links 16 as the change over lever 11 is rotated in a direction in which the driving force transmitted to the brush 3 is cut off. There is a trap 20 at one end of the arch formed guide long hole 15 for catching the belt shaft 6 to prevent an easy return of the belt shaft 6 to an original position when the change over lever 11 rotates in a direction in which the driving force of the motor 2 transmitted to the brush 3 is cut off. The notch 17 in each of the connection links 16 has an "L" form, and the free end of the elastic piece 18 has an "L" bend 19 and 27 in conformity with the notch 17. And, the connection links 16 are rotatably coupled to the middle of the arm 12. In the meantime, the connection links 16 are connected to both ends of the belt shaft 6 on opposite sides of the support frame 5*a* to face each other as double layered plate, for preventing eccentricity of the belt shaft 6 due to a belt tension. There is a supplementary connection plate 21 formed by bending between the connection links 16 and the arm 12. Contacts between the belt shaft 6 and the connection links 16 are caulked for preventing fall off of the belt shaft 6 from the connection links 16. And, there is a stopper 22 provided at a low end of the support frame 5*a* for limiting a rotating range of the change over lever 11 when the change over lever 11 is rotated in a driving direction of the brush 3, and there is a projection piece 23 at a low end of the change over lever 11 for being caught by the stopper 22. And, there is a rolling ring 24 on the belt shaft 6 between the connection links 16 for smooth movement of the belt shaft 6 along the guide long hole 15 in handling the change over lever 11. The fixation end of the elastic piece 18 is fastened by a screw to a bracket formed by bending at a top of the support frame 5*a*.

The operation of the aforementioned device for driving/stopping a brush of a vacuum cleaner in accordance with a second preferred embodiment of the present invention will be explained.

Alike to the first embodiment of the present invention, the brush 3 is either put into operation or not depending on a floor condition of a cleaning object in a cleaning using the vacuum cleaner. That is, if a surface of the cleaning object is textile, such as carpet, the cleaning is carried out with the brush 3 rotated, and if the surface of the cleaning object is a hard surface, such as floor, the cleaning is carried out with the brush 3 stopped.

First, the operation of the device for driving/stopping a brush of a vacuum cleaner in accordance with a second preferred embodiment of the present invention will be explained in detail in the case when textile, such as carpet, is cleaned.

Figure 6A:
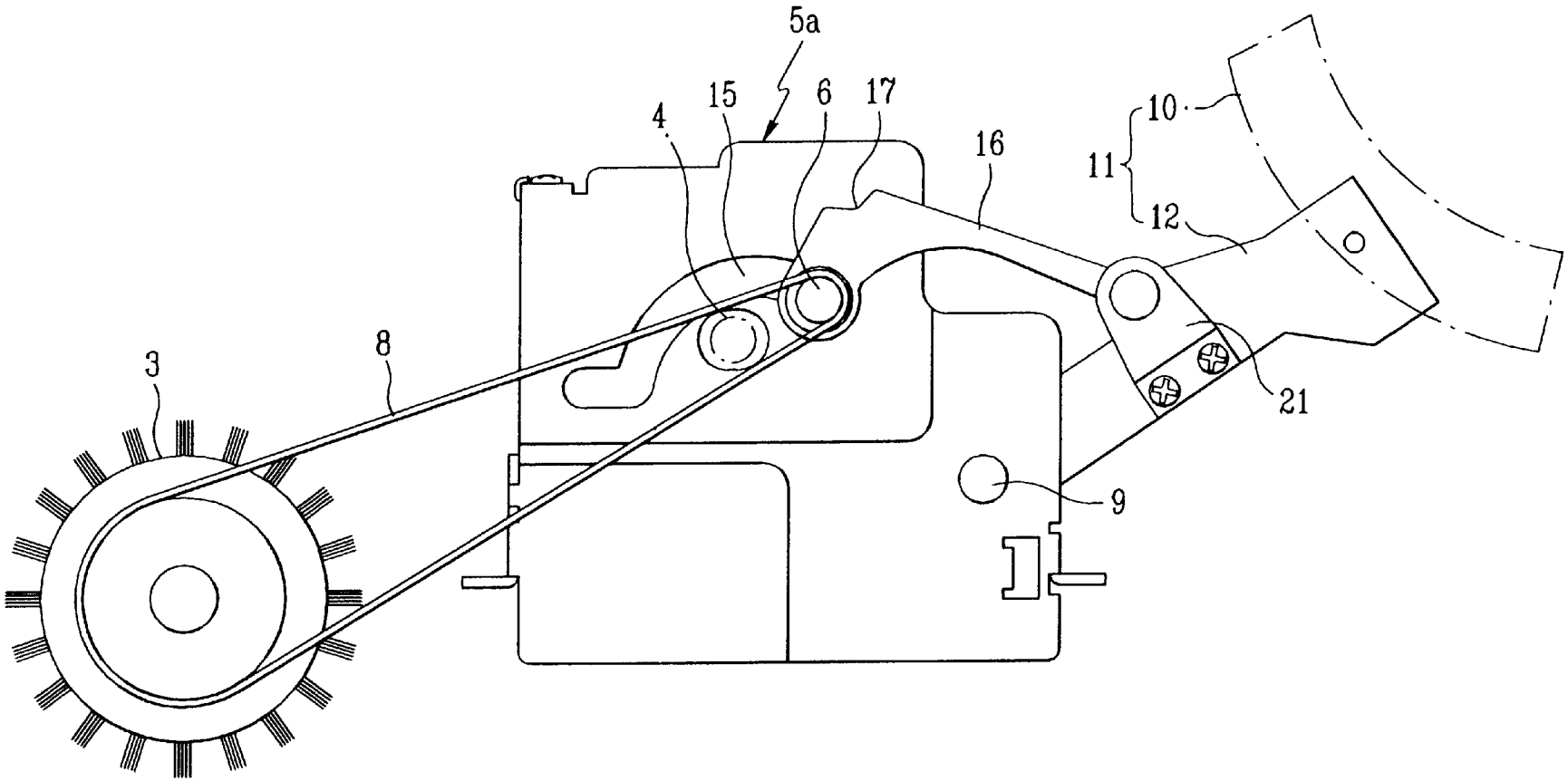
Figure 6B:
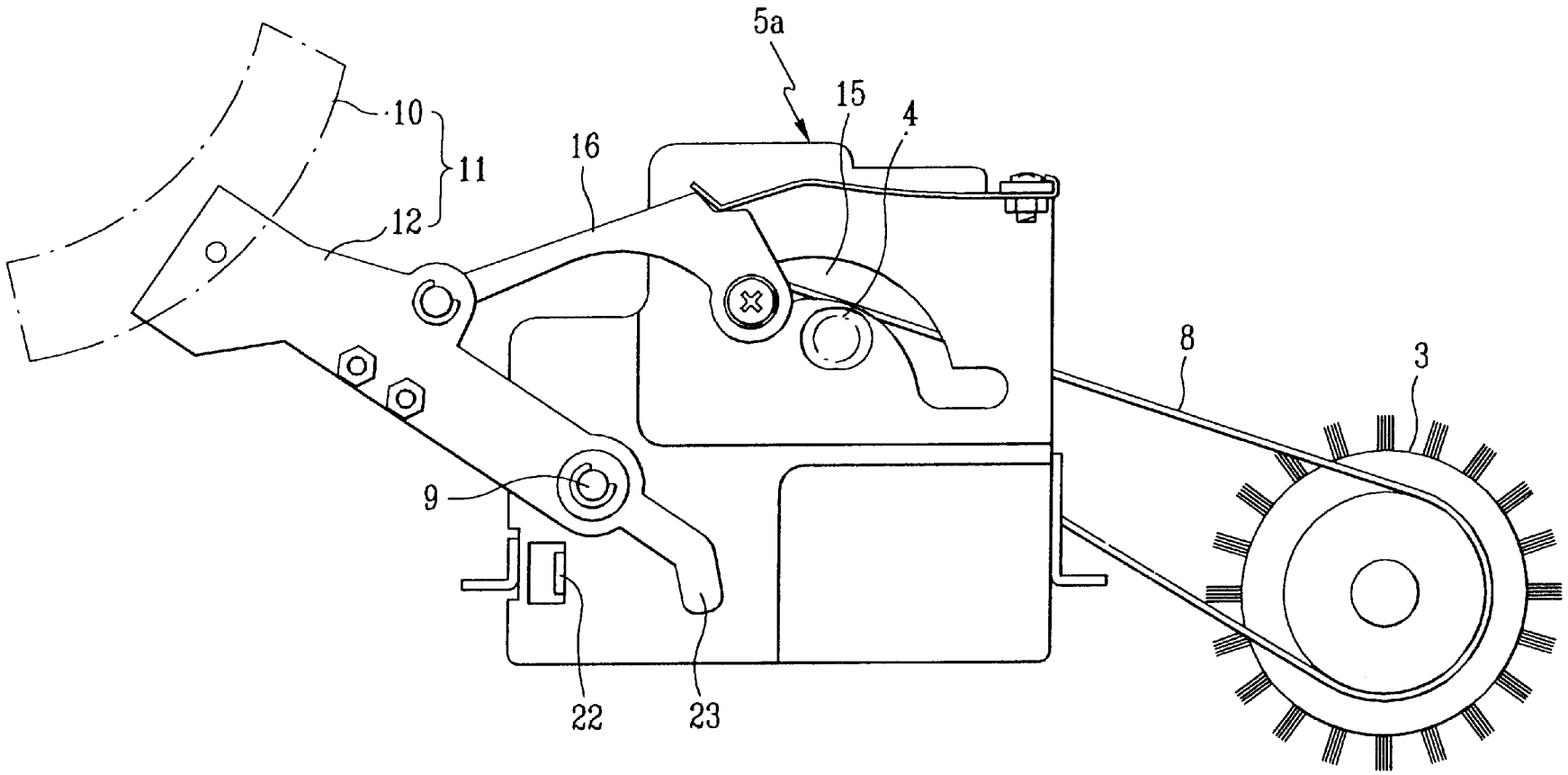
Figure 7A:
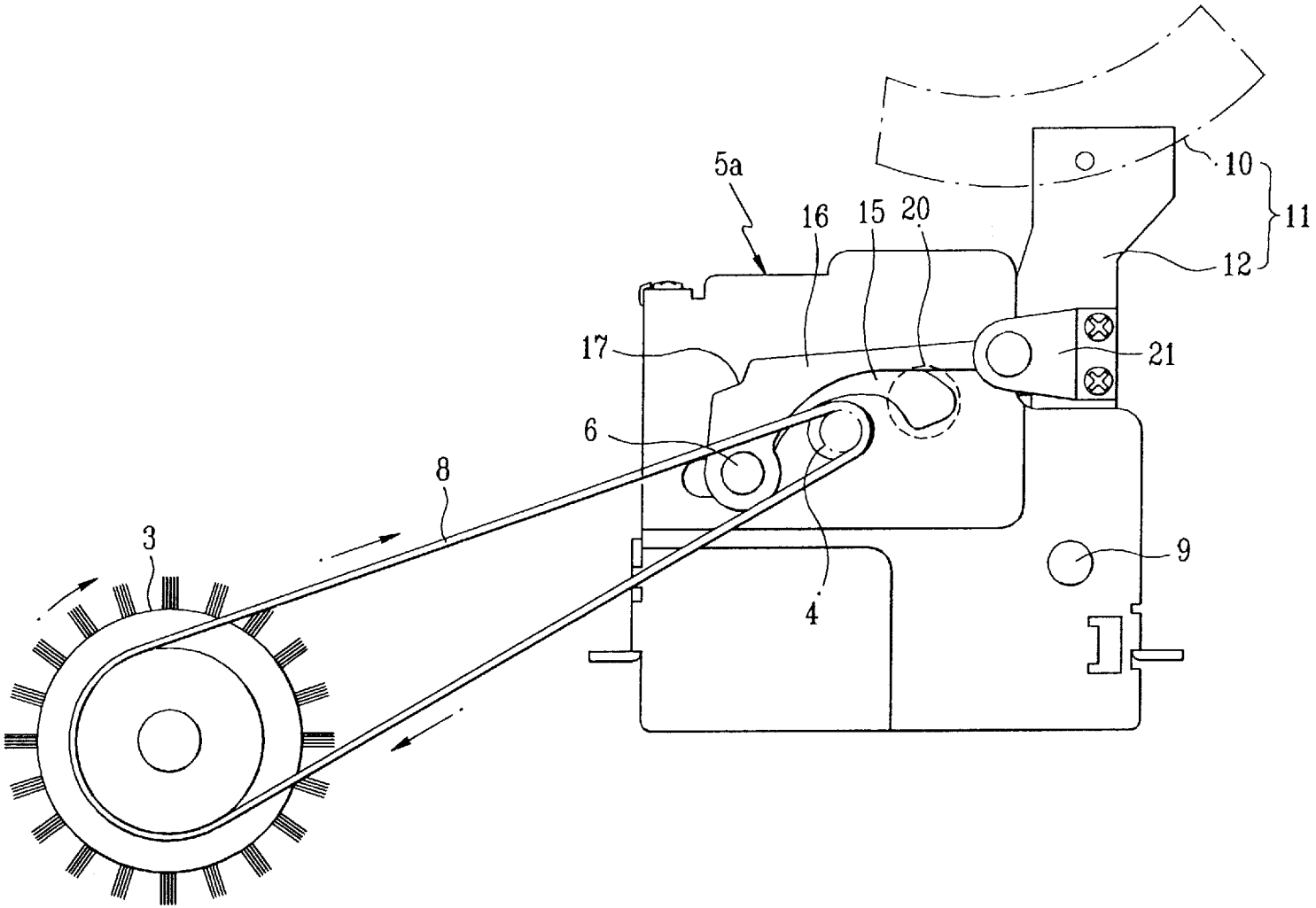
Figure 7B:
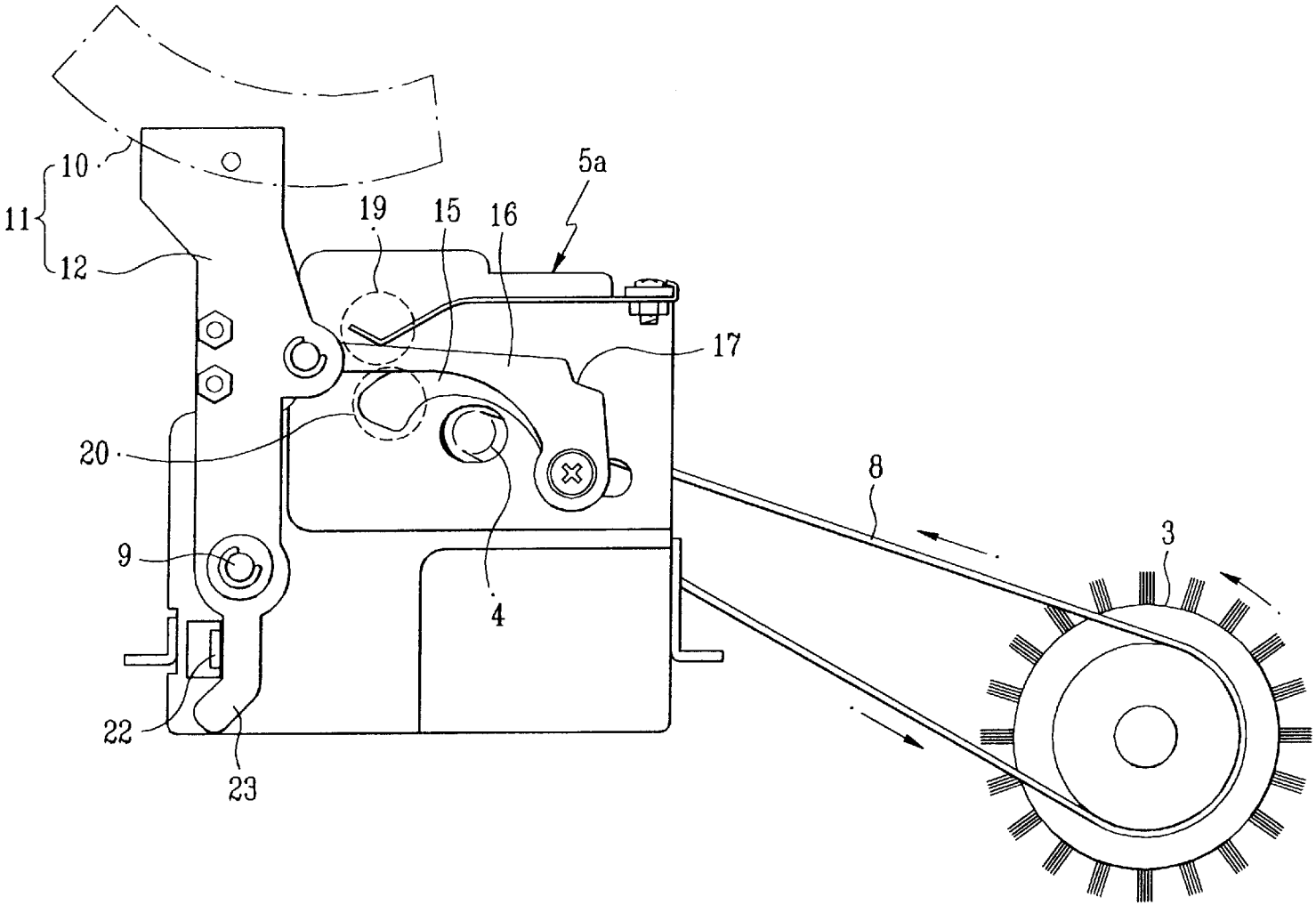

Referring to FIGS. 6*a* and 6*b,* in a condition that the belt 8 is connected between the motor shaft 4 and the belt shaft 6, with the rotating force of the motor shaft 4 not transmitted to the brush 3, when the user pushes the change over lever 11 forward(a left direction in FIG. 6*a* or a right direction in FIG. 6*b*) with a foot, the change over lever 11 starts to rotates in a counter clockwise direction centered on the hinge shaft 9, and the change over lever 11 rotates rapidly from a time point the change over lever 11 passes through a toggle point because the connection link connected to the change over lever 11 receives a pressing force from a restoration force of the elastic piece 18 even if no stepping force is exerted thereto. That is, as the belt shaft 6 escapes from the trap 20 which is one region of the guide long hole 15, the restoration force of the elastic piece 18 and tension of the belt 8 pulls the connection links 16 connected to the arm 12 of the change over lever 11 toward the brush 3(a left side in FIG. 6*a* or a right side in FIG. 6*b*), to move the belt shaft 6 fitted to pass through the connection links 16 toward a brush 3 side along the guide long hole 15, according to which the change over lever 11 connected to the belt shaft 6 also rotates centered on the hinge shaft 9. The rotation of the change over lever 11 is stopped by the stopper 22 projected from a low end of the support frame 5*a,* putting the change over lever 11 to an upright position as shown in solid lines in FIG. 7*a*. In this instance, the force pushing the change over lever 11 forward should be enough for the belt shaft 6 in the trap 20 in the guide long hole 15 to escape from the trap 20, permitting the change over lever 11 to be freed from a locked state. When the change over lever 11 is freed from the locked state and upright as shown in FIG. 7*a,* the belt 8, having connected between the belt shaft 6 and the brush 3, connects between the motor shaft 4 and the brush 3. According to this, the driving force of the motor 2 is transmitted to a shaft of the brush 3 through the belt 8 on the motor shaft 4 to rotate the brush 3, thereby brushing on the textile, such as carpet, allowing an efficient cleaning on the surface of the cleaning object.

In the meantime, in the case when a floor or a hard surface without the textile is cleaned, the user applies a stepping force on the foot step 10 of the change over lever 11, to rotate the change over lever 11 in a clockwise direction centered on the hinge shaft 9. That is, as shown in FIG. 7*a*, in a condition the motor shaft 4 and the brush 3 shaft are connected by the belt 8, if a stepping force is applied to the change over lever 11 to rotate in a clockwise direction on the drawing centered on the hinge shaft 9, the change over lever 11 starts to rotate in a direction of an arrow shown in FIGS. 7*a* and 7*b*. In this instance, a force pushing the free end of the elastic piece 18 upward is exerted on the elastic piece 18 which is in contact with a top surface of the connection links 16, the belt shaft 6 connected to the connection links 16 is positioned in the trap 20 in the guide long hole 15 after a while, putting the change over lever 11 to a state as shown in FIGS. 6*a* and 6*b*. That is, as the stepping force is applied to the change over lever 11 to rotate in a clockwise direction on FIG. 7*a,* there is a state change from an initial state in which the belt shaft 6 is positioned between the motor shaft 4 and the brush 3 to a state in which the motor shaft 4 is positioned between the belt shaft 6 and the brush 3, resulting in the driving force of the motor being not transmitted to the belt 8, but the motor shaft 4 idling, cutting off transmission of the driving force of the motor 2 to the brush 3. In the meantime, from a time point the belt shaft 6 is positioned in the trap 20, the change over lever 11 is held locked by means of geometric relation between the belt shaft 6 and the guide long hole 15 and a holding action of the elastic piece 18 on the notches 17 of the connection links. In summery, the device for driving/stopping a brush of a vacuum cleaner in accordance with a second preferred embodiment of the present invention can connects/disconnects a motor driving force transmission to the brush 3 by means of an interlocked action of the support frame 5*a* having arch formed guide long hole 15 and the stopper 22, the connection links 16 having notches 17, the elastic piece 18, the change over lever 11, and the belt shaft 6.

The device for driving/stopping a brush of a vacuum cleaner of the present invention has the following advantages.

The possibility of connection/disconnection of brush without parallel and total movement of the belt of the present invention in a selective driving/stopping of brushing depending on a condition of a surface of the cleaning object allows a smooth change over of the brush rotation. Particularly, the device of the present invention can prolong a lifetime of the belt because there are no idling of the belt as the case of related art in connection/disconnection of the driving force of the motor and no interference with the belt shift handling lever in the related art. Moreover, the possibility of handling the device by means of users foot as the user stands can eliminate the inconvenience of handling the device with the user bent down in the related art.

It will be apparent to those skilled in the art that various modifications and variations can be made in the device for driving/stopping a brush of a vacuum cleaner of the present invention cf the present invention without departing from the spirit or scope of the invention. Thus, it is intended that the present invention cover the modifications and variations of this invention provided they come within the scope of the appended claims and their equivalents.

What is claimed is:

1. A device for driving/stopping a brush of a vacuum cleaner comprising:

a driving motor built in a body of the vacuum cleaner;

a brush fitted in front of the driving motor in the body of the vacuum cleaner;

a support frame fixed inside of the body and having the motor shaft of the driving motor rotatably passed through a surface thereof;

a first link of a circular arc cam form rotatably mounted on an outer circumference of the motor shaft passed through the support frame centered on the motor shaft without interference with the motor shaft and having a belt shaft fitted at a fore end thereof;

a belt for connecting between the belt shaft and the brush;

a change over lever fitted at one side of rear of the motor shaft in the support frame to be rotatable centered on a hinge shaft and having a foot step for applying a stepping force thereto for connecting/disconnecting a driving force of the motor to the brush;

a second link of an arch form connected between a middle of an arm of the change over lever and the belt shaft; and, an elastic member connected between a rear wall of the support frame and one side of the arm of the change over lever.

2. A device as claimed in claim 1, wherein the elastic member is a tension spring.

3. A device for driving/stopping a brush of a vacuum cleaner comprising:

a driving motor built in a body of the vacuum cleaner;

a brush fitted in front of the driving motor in the body of the vacuum cleaner;

a support frame fixed in the body and having a motor shaft pass through hole with the motor shaft of the driving motor rotatably passed therethrough and a guide long hole of an arch form;

a belt shaft passed through the guide long hole for being moved along the guide long hole;

a belt for connecting the belt shaft and the brush;

a change over lever fitted to the support frame on a surface thereof at rear of the motor shaft to be rotatably centered on a hinge shaft and having a foot step at a fore end thereof for applying a stepping force thereto, for connecting/disconnecting a driving force of the motor to the brush;

connection links each connected between a middle of an arm of the change over lever and the belt shaft and having an elastic piece notch at one side thereof, and, an elastic piece having a fixation end fixed to one side of a top portion of the support frame and a free end formed downwardly, for the free end pressing down upper sides of the connection links when the change over lever is upright and preventing return of the change over lever by the free end being caught at the notches in the connection links as the change over lever is rotated in a direction in which the driving force transmitted to the brush is cut off.

4. A device as claimed in claim 3, wherein the guide long hole of an arch form has a trap for trapping the belt shaft to prevent return of the belt shaft to an original position when the change over lever is rotated in a direction in which the driving force of the motor transmitted to the brush is cut off.

5. A device as claimed in claim 3, wherein the notch in each of the connection links has an "L" form, and the free end of the elastic piece has an "L" bend in conformity with the notch.

6. A device as claimed in claim 3, wherein the connection links are rotatably coupled to middle of the arm.

7. A device as claimed in claim 3, wherein the connection links are connected to both ends of the belt shaft on opposite sides of the support frame to face each other as double layered plate, for preventing eccentricity of the belt shaft due to a belt tension.

8. A device as claimed in claim 7, wherein there is a supplementary connection plate formed by bending between the connection links and the arm.

9. A device as claimed in claim 3, wherein there is a stopper provided at a low end of the support frame for limiting a rotating range of the change over lever when the change over lever is rotated in a driving direction of the brush, and there is a projection piece at a low end of the change over lever for being caught by the stopper.

10. A device as claimed in claim 3, wherein there is a rolling ring on the belt shaft between the connection links for smooth movement of the belt shaft along the guide long hole in handling the change over lever.

* * * * *